US006687569B1

(12) United States Patent
Skinger et al.

(10) Patent No.: US 6,687,569 B1
(45) Date of Patent: Feb. 3, 2004

(54) CONFIGURABLE MULTI-STATION BUFFER TRANSPORT FOR AN INSERTER SYSTEM

(75) Inventors: Gregory P. Skinger, Southbury, CT (US); John W. Sussmeier, Cold Spring, NY (US); John R. Masotta, Milford, CT (US); William J. Wright, Killingsworth, CT (US)

(73) Assignee: Pitney Dowes Inc., Stamford, CT (US)

( * ) Notice: Subject to any disclaimer, the term of this patent is extended or adjusted under 35 U.S.C. 154(b) by 0 days.

(21) Appl. No.: 10/328,971

(22) Filed: Dec. 24, 2002

(51) Int. Cl.[7] ..... G06F 7/00

(52) U.S. Cl. ..... 700/220; 700/223; 700/228; 271/272; 271/3.2; 271/265.02; 271/189; 270/58.02; 270/52.09

(58) Field of Search ..... 700/219, 220, 700/223, 228, 230; 271/272, 3.2, 3.24, 7, 256, 265.02, 265.03, 266, 69, 189; 270/52.01, 58.01, 59, 58.02, 52.09

(56) References Cited

U.S. PATENT DOCUMENTS 5,110,115 A * 5/1992 Couper ..... 271/265.02
5,465,955 A * 11/1995 Krupica et al. ..... 271/265.02
5,826,157 A * 10/1998 Wierszewski ..... 399/396
5,848,784 A * 12/1998 Tranquilla ..... 271/10.03
6,062,557 A * 5/2000 Kusumi ..... 271/10.13
6,131,053 A * 10/2000 Nyffenegger et al. ..... 700/220
6,378,687 B1 * 4/2002 Lem et al. ..... 198/349.95
6,488,279 B1 * 12/2002 Fukuda et al. ..... 271/314

* cited by examiner

*Primary Examiner*—Patrick Mackey
(74) *Attorney, Agent, or Firm*—Michael J. Cummings; Charles R. Malandra, Jr.; Angelo N. Chaclas

(57) ABSTRACT

A buffer transport system for staging accumulated documents produced by an input module of an inserter system. The system including a plurality of roller nips in series. Each of the roller nips are driven by an independently controllable motor in communication with a controller. The series of roller nips form stopping stations along the length of the buffer transport. Each of the stopping stations has a uniform length and is comprised of two or more of the roller nips. The roller nips in any given stopping station are electronically geared together under the control of the controller. The controller controls stopping stations to transfer accumulated documents within the stopping stations to a next downstream stopping station when it is sensed that the next downstream stopping station is open. If the next downstream station from a given station is not open, then the controller does not instructs the station to transfer documents downstream. The stopping stations are configurable between at least a first configuration and a second configuration. The second configuration having more roller nips in each station than in the first configuration. The first configuration includes more stopping stations, of shorter length, over the fixed length of the buffer transport than the second configuration.

6 Claims, 3 Drawing Sheets

CONFIGURABLE MULTI-STATION BUFFER TRANSPORT FOR AN INSERTER SYSTEM

TECHNICAL FIELD

The present invention relates to a buffer transport module in a high speed mass mail processing and inserting system. The buffer transport provides a staging area for transferring asynchronously produced accumulations of documents generated by the inserter input subsystem to the synchronous transport of the inserter chassis. The buffer transport further provides "parking spots" for accumulations of documents that are already in the process of creation when downstream modules stop.

BACKGROUND OF THE INVENTION

Inserter systems, such as those applicable for use with the present invention, are typically used by organizations such as banks, insurance companies and utility companies for producing a large volume of specific mailings where the contents of each mail item are directed to a particular addressee. Also, other organizations, such as direct mailers, use inserts for producing a large volume of generic mailings where the contents of each mail item are substantially identical for each addressee. Examples of such inserter systems are the 8 series, 9 series, and Advanced Productivity System (APS™) inserter systems available from Pitney Bowes Inc. of Stamford Conn.

In many respects, the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

The input stages of a typical inserter system are depicted in FIG. 1. At the input end of the inserter system, rolls or stacks of continuous printed documents, called a "web," are fed into the inserter system by a web feeder 10. The continuous web must be separated into individual document pages. This separation is typically carried out by a web cutter 20 that cuts the continuous web into individual document pages. Downstream of the web cutter 20, a right angle turn 30 may be used to reorient the documents, and/or to meet the inserter user's floor space requirements.

The separated documents must subsequently be grouped into collations corresponding to the multi-page documents to be included in individual mail pieces. This gathering of related document pages occurs in the accumulator module 40 where individual pages are stacked on top of one another.

The control system for the inserter senses markings on the individual pages to determine what pages are to be collated together in the accumulator module 40. In a typical inserter application, mail pieces may include varying number of pages to be accumulated. For example, the phone bill for a person who lives by himself may be much shorter than the another phone bill representing calls made by a large family. It is this variation in the number of pages to be accumulated that makes the output of the accumulator 40 asynchronous, that is, not necessarily occurring at regular time intervals.

Downstream of the accumulator 40, a folder 50 typically folds the accumulation of documents, so that they will fit in the desired envelopes. To allow the same inserter system to be used with different sized mailings, the folder 50 can typically be adjusted to make different sized folds on different sized paper. As a result, an inserter system must be capable of handling different lengths of accumulated and folded documents.

Downstream of the folder 50, a buffer transport 60 transports and stores accumulated and folded documents in series in preparation for transferring the documents to the synchronous inserter chassis 70. By lining up a back-log of documents in the buffer 60, the asynchronous nature of the upstream accumulator 40 will have less impact on the synchronous inserter chassis 70. For example, if a particularly long phone bill were being formed in the accumulator 40, a larger than normal gap might form with the preceding document. However, this gap will not have an affect on synchronous placement of documents on the chassis 70 because the buffer 60 preferably includes enough documents that the longer document can "catch up" before its turn to be placed on the synchronous chassis 70.

Another important function of the buffer 60 is its ability to "park" document accumulations when the chassis 70 is stopped, or otherwise unable to accept documents. When the chassis 70 must be stopped, for example as a result of a jam, a signal is typically sent to the web feeder 10 and web cutter 20 to cease operating. However, pages that are already in the process of being cut, or that are in the right angle turn 30, or in the folder 50, need a place to come to rest. Such components in the inserter input stage run all the time, and do not have the capability of halting part-way through their processes.

The accumulator 40 typically provides one or two parking spots, or stopping stations, for such documents that are "in progress." However, documents in the. accumulator 40 may have to be sent downstream to make room for further "in progress" documents from upstream. When the chassis 70 is stopped, there must be at least enough stopping stations in the buffer 60 and accumulator 40 to accept all of the "in progress" documents and pages. In particular, when the mail pieces are comprised of shorter numbers of pages, more stopping stations may be needed because more document accumulations result from the same number of pages being cut.

Accordingly, it is desirable that the buffer 60 be designed to include enough stopping stations to satisfy the parameters of the accumulation lengths and page counts as required by the inserter user.

In the prior art buffer depicted in FIG. 2, six stopping stations are provided over a forty-two inch buffer length. The space within each stopping station being seven inches. Each of the prior art stopping stations, 1, 2, 3, 4, 5, and 6, includes a roller nip 14. When a document accumulation must stop at a stopping station, the respective roller nip 14 is stopped. When it is time for a document accumulation to move to the next stopping station, the respective roller nip 14 drives the accumulation downstream.

The seven inch spacing between roller nips 14 is longer than the typical document accumulation to be transported.

Accordingly, a mechanism for moving accumulations between roller nips 14 is provided. This mechanism is comprised of o-ring belts 13 that are driven around the length of the buffer transport system by rollers 12. These o-ring belts 13 and rollers 12 run continuously and provide for transportation of accumulations between roller nips 14 at different stopping stations. The o-ring belts 13 continue to run even when one or more of the stopping stations and respective roller nips 14 are stopped. When an accumulation is stopped at the roller nips 14, the o-ring belts 13 slip over and under the accumulations. Accordingly, the tension of the o-ring belts 13 is light, and the surfaces in contact with the accumulations have low friction. As such, rollers 12 and belts 13 are incapable of implementing any control over the stopping and starting of movement of documents in the buffer. Rather, control of the relative movement of documents within the buffer is provided by the roller nips 14.

The roller nips 14 are controlled in accordance with predetermined rules for moving documents within the buffer. When a sensor 11 detects an accumulation within a first stopping station, a decision must be made about what to do with it. Accordingly, when a downstream accumulation is detected in the immediate downstream stopping station, then the accumulation is held in the first stopping station. If there is no accumulation in the immediate downstream stopping station, then the roller nip 14 moves the accumulation downstream to the next station. This logic is used for each of the stopping stations 1–6 for every period in the control cycle. Accordingly, documents are generally shifted towards the downstream end of the buffer as stations become available.

SUMMARY OF THE INVENTION

While the prior art system described above often performs satisfactorily, the forty two inch buffer length and seven inch stopping station length are often longer than necessary to handle documents being processed. While these dimensions might be necessary to handle the longest documents to be handled by the inserter system, a more typical letter sized page folded into thirds would be roughly four inches long. Many accumulations are shorter still.

Accordingly, the prior art arrangement shown in FIG. 2, often uses more floor space than necessary for a given mail piece creation job. Floor space being an important consideration for large pieces of equipment such as inserters, it is desirable to achieve the same (or greater) functionality in less space.

Another shortcoming of the arrangement in FIG. 2, occurs if more stopping stations are desired to provide more parking spaces for a user who wants to run a job with accumulations having low page counts and short documents. In this situation, there is no way to advantageously use the additional space available in the conventional buffer. The conventional buffer is configured to provide a fixed number of stopping stations for fixed maximum length documents, and this configuration cannot be easily adjusted. As cutters and feeders increase in speed, there may be a need for more stopping stations, particularly when a job includes low page count mail pieces. Thus, the "parking" purpose of the buffer becomes more significant to sustain increases in system throughput performance.

The present invention provides a solution to these shortcomings by providing a more flexible buffer transport system that can use the available length of the buffer transport to more efficiently meet the particular needs of a given mail piece job run.

Accordingly, the present invention comprises a buffer transport system for staging accumulated documents produced by an input module of an inserter system prior to transfer to a downstream synchronous transport. The buffer transport includes a plurality of roller nips in series and spaced a uniform distance apart. The nips are spaced close enough to transfer minimum length accumulated documents between them. Each of the roller nips are driven by an independently controllable motor, preferably a servo motor, in communication with a controller.

The series of roller nips form stopping stations along the length of the buffer transport. Each of the stopping stations have a uniform length and are comprised of two or more of the roller nips. The roller nips in any given stopping station are electronically geared together and operate in unison under the control of the controller. The stopping stations are controlled by the controller (1) to receive accumulated documents from upstream, (2) to stop accumulated documents within the stopping station, and (3) to transfer accumulated documents downstream.

In the preferred embodiment, sensors to detect the presence of documents in the stopping stations are located at a downstream end of each of the stopping stations. When documents are present in a most downstream stopping station, the controller directs those documents to the synchronous inserter chassis. The controller further controls each stopping station to transfer accumulated documents within each stopping station to a next downstream stopping station when it is sensed that the next downstream stopping station is open. If the next downstream station from a given station is not open, then the controller does not instructs the station to transfer documents downstream.

The stopping stations of the present invention are configurable by the controller between at least a first configuration and a second configuration. In the first configuration of stopping stations, a first quantity of roller nips are in each stopping station. In the second configuration, each stopping stations has a second quantity, greater than the first quantity, of roller nips. Such change in configurations is achieved by redefining the stopping stations by changing which roller nips are electronically geared together to form the stations. Thus, the first configuration will include more stopping stations over the fixed length of the buffer transport than the second configuration, and the configurations may be changed to more efficiently use the available space to better suit the particular needs of the user.

Further details of the present invention are provided in the accompanying drawings, detailed description and claims.

DETAILED DESCRIPTION

Figure 1:
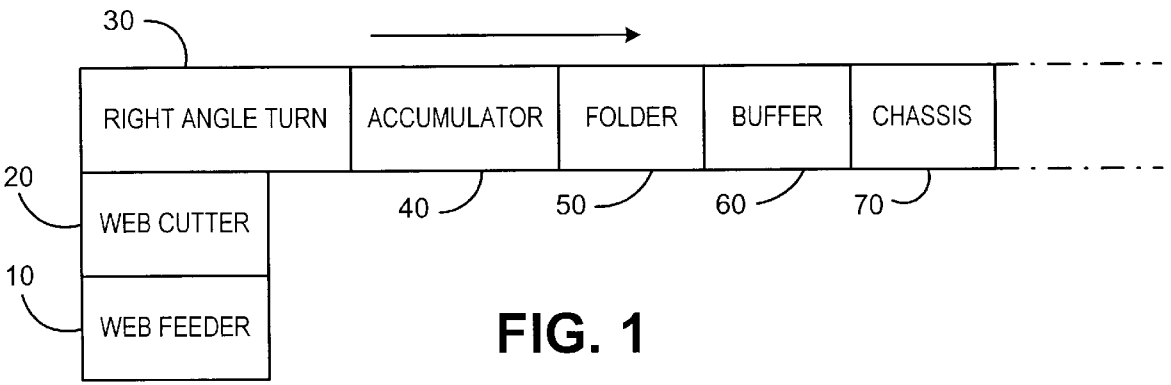
FIG. 1 is a diagram of the input stages of an inserter system for use with the present invention.
Figure 2:
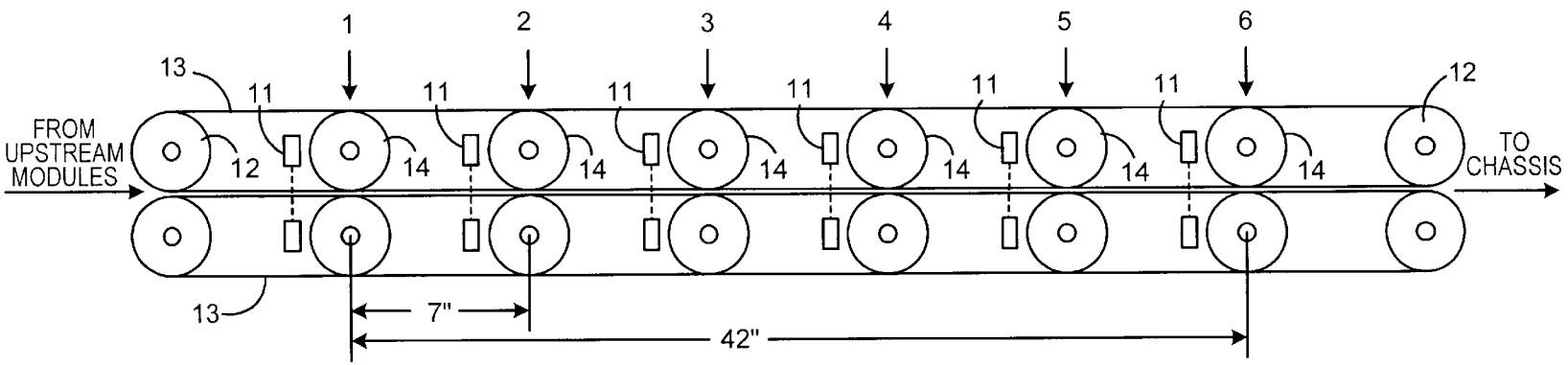
FIG. 2 (PRIOR ART)
FIG. 2 depicts a prior art buffer transport.
Figure 3:
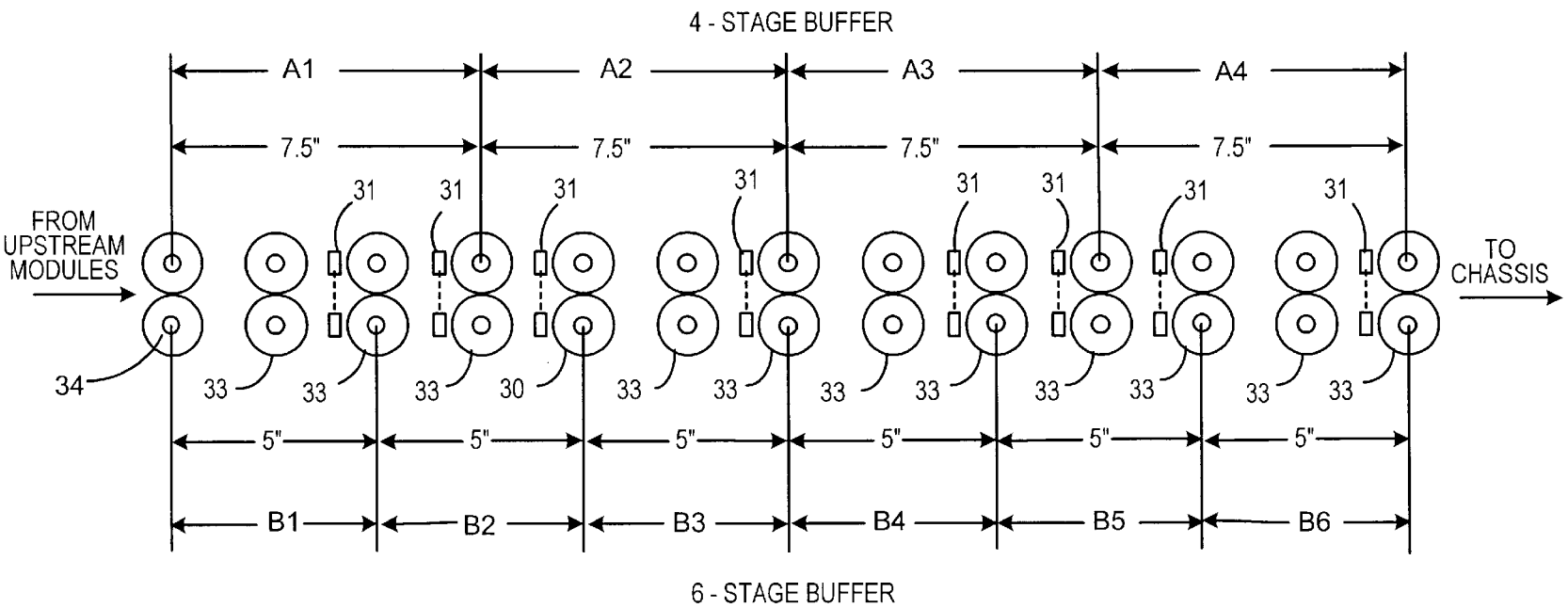
FIG. 3 depicts a preferred buffer transport in accordance with the present invention.
Figure 4:
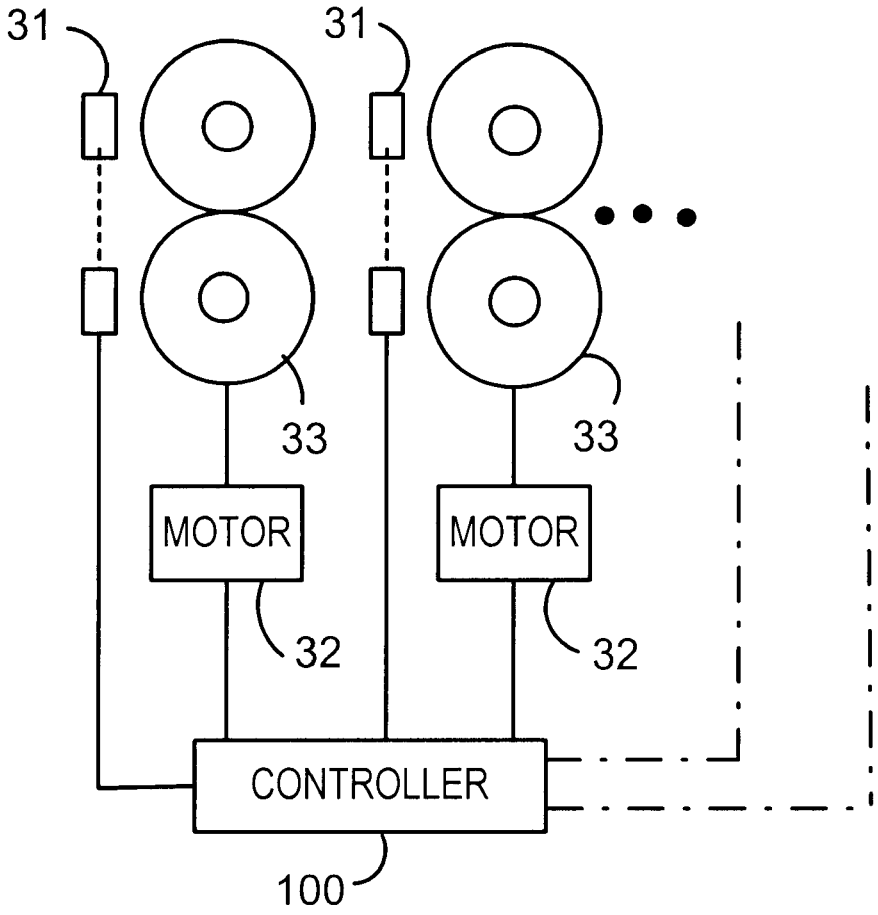
FIG. 4 is a more detailed look at the control for driving the roller nips in accordance with a preferred embodiment.

FIG. 3 provides a schematic representation of a preferred buffer transport in accordance with the present invention. The buffer transport is comprised of a plurality of roller nips 33. Document accumulations are fed into the system via rollers 34 at the upstream end of the transport. As seen in FIG. 4, each of the roller nips is independently driven by a servo motor 32 controlled by controller 100. Controller 100 provides the control for the movement of the individual nips 33 in the system as well as determining which of the nips 33, and corresponding motors 32, should be electronically geared together to suit the motion requirements of the present invention.

The servo motors 32 for use with the present invention are preferably capable of a velocity of 100 inches per second, and 8.6 G's of acceleration. These capabilities will allow the buffer transport to support inserter system throughput speeds up to 18,000 mail pieces per hour.

The consecutive roller nips 33 are preferably spaced apart a distance sufficient that they may successfully pass the smallest length accumulation of documents from one to another. In a preferred embodiment, this distance may be approximately two and a half inches. Accordingly, the entire buffer in FIG. 3 having twelve nips 33 would be thirty inches long.

The preferred embodiment of FIG. 3 depicts a buffer transport that is configurable to include either four stopping stations, or six stopping stations. In the four station configuration, the stations are labeled as A1, A2, A3, and A4. Station A1 is comprised of the first three roller nips 33 starting at the upstream end of the buffer transport. A2 is comprised of the subsequent three nips 33 downstream from station A1. A3 is similarly composed downstream of A2, while A4 is comprised of the last three roller nips 33 at the end of the buffer transport.

The three roller nips 33 that make up any of the four stations in the four station configuration are electronically geared together to operate in unison when receiving motion commands from the controller 100. If, for example, controller 100 were to command that a document accumulation be moved from station A1 to station A2, then all of the roller nips in station A1 would act in unison to deliver the document downstream. For this example, the controller 100 would also require that the three nip rollers 33 of A2 move to receive the document from A1, and such nips 33 of station A2 would have to act in unison with the nips of station A1 to effectuate that transfer.

The four station configuration would be used when the document accumulations to be transported in the buffer are between five (5) and seven and a half (7.5) inches long. In the preferred embodiment using nips 33 spaced two and a half inches apart, at least three nips 33 are required to handle documents over five inches. Documents over seven and a half inches would require yet a fourth nip, and could not be handled in four station configuration.

If a user wants to process documents less than five inches, the first configuration of A1–A4 would be capable of doing so, but there would be extra space that is not being used, and potential throughput could be affected by a lack of parking spaces. Accordingly, for these smaller documents, the present invention allows the controller 100 to change the configuration of the buffer transport for six station operation. Under this six station configuration, only the first two roller nips 33 would be part of the first station B1. The next two roller nips would be part of station B2, and so on down the line for B3–B6. Under this configuration, one of the nips 33 that was previously in station A1, is now part of station B2. Accordingly, the controller 100 must reconfigure which roller nips 33 are electronically geared together to form the six stations.

A third configuration, not shown in FIG. 3, could also be made to accommodate documents over seven and a half inches. Under this third configuration each stopping station would be comprised of four roller nips 33, and there would be a total of three stopping stations over the length of the buffer transport. It will be understood by those skilled in the art that the accelerations, velocities, dimensions and quantities of nips 33 and quantities of stopping stations as shown in FIG. 3 are only exemplary. Many variations on configurability may be made by adjusting the spacing, quantity, and electronic gearing of the nips 33.

Once the configuration of the stopping stations is determined, and the appropriate rollers 33 have been electronically geared together by controller 100, the logic for operating each stopping station is the same. In the preferred embodiment, sensors 31 detect the presence of documents in the stopping stations. Sensors 31 are preferably optical sensors that detect the presence of documents in the stopping stations. The sensor signals are provided to the controller 100 for determining the appropriate motion control for handling the documents in the buffer transport.

Sensors 31 are preferably located at the downstream end of each stopping station, for each configuration of stopping stations that the system may use. A preferred location for the sensors 31 is such that a light beam from the sensors 31 intersects the point where the rollers of the nip 33 touch. Thus, for example, it is preferred that in the system of FIG. 3, a sensor 31 be located proximal to second nip 33 in the transport, at the downstream end of station B1. The next downstream sensor 31 would be located at the nip 33 located at the downstream end of station A1. Under this preferred arrangement, there is no need for sensors 31 at the first, fifth, eighth, or eleventh roller nips 33 in the buffer transport, because those nips 33 are not at the downstream ends of the stations in either the four station or six station configurations. For simplicity, however, sensors 31 may be included at every roller nip 33.

The controller 100 controls the electronically geared together nips 33 of the stations as follows. At every period in a control cycle, the controller 100 determines from sensors 31 whether there is a document in each of the stations. When documents are present in a most downstream stopping station, the controller 100 directs those documents to be transferred to the downstream synchronous inserter chassis. If the chassis is running, a synchronous signal will indicate to the controller 100 that a space on the chassis is arriving, and the nips 33 of the most downstream station (A4 or B6 in FIG. 3) will transfer documents located therein to the space on the chassis.

Upstream of the most downstream station, the controller 100 determines if there is a document in the station, and if the sensors 31 indicate that there is a document in the next downstream station, then the document is retained in the station for that period. If there is no document in the next downstream station, then the nips 33 of the station, and of the downstream station, are instructed to transfer the document to the downstream station. Using this logic, documents fill the stations at the downstream end of the buffer transport as openings become available.

When a document accumulation is required to come to a stop at one of the stations, the roller nips 33 and servo motors 32 will require some period of time and distance to deceleration from the transport velocity. In the preferred embodiment, the motors 32 require 30 ms and one and a half inches to decelerate from maximum speed to a full stop. Accordingly, the staged position for documents stopped in a station will be one and a half inches from the stations last roller nip 33.

The preferred embodiment of the invention described herein makes more efficient use of space than the prior art system described herein. Also, the positive control provided by the servo controlled nips 33 eliminates some unreliability that resulted from the prior art system's use of the continuously running o-ring belts.

Although the invention has been described with respect to preferred embodiments thereof, it will be understood by those skilled in the art that the foregoing and various other changes, omissions and deviations in the form and detail thereof may be made without departing from the spirit and scope of this invention.

What is claimed is:

1. A buffer transport system for staging accumulated documents produced by an input module of an inserter system prior to transfer to a downstream synchronous transport for downstream processing in the inserter system, the buffer transport comprising:

a plurality of roller nips in series and spaced a uniform distance apart, the uniform distance being close enough to transfer minimum length accumulated documents between consecutive roller nips, each of the roller nips driven by an independently controllable motor in communication with a controller;

a plurality of stopping stations along the length of the buffer transport, each of the stopping stations having a uniform length and comprised of two or more of the plurality of roller nips operating in unison under the control of the controller to receive accumulated documents from upstream, to stop accumulated documents within the stopping station, and to transfer accumulated documents downstream;

a plurality of sensors in communication with the controller each of the sensors located at a downstream end of each of the stopping stations, the sensors sensing the presence of accumulations of documents within the stopping stations;

the controller instructing a most downstream stopping station to deliver accumulated documents sensed within the most downstream stopping station to the downstream synchronous transport, the controller further controlling each stopping station to transfer accumulated documents within each stopping station to a next downstream stopping station when it is sensed that the next downstream stopping station is open, the controller further controlling each stopping station not to transfer accumulated documents within the stopping station when it is sensed that the next downstream stopping station is occupied;

and wherein the plurality of stopping stations are configurable by the controller between at least a first configuration and a second configuration of stopping stations, the first configuration of stopping stations having a first quantity of roller nips in each stopping station, the second configuration of stopping stations having a second quantity, greater than the first quantity, of roller nips in each stopping station, and whereby the first configuration will include more stopping stations over a fixed length of the buffer transport than the second configuration.

2. The buffer transport system of claim 1 wherein controller instructs the input module to stop creation of new accumulations of documents when a quantity of open stopping stations equals a quantity of accumulations that are already in production by the input module.

3. The buffer transport system of claim 1 wherein the roller nips are spaced 2.5 inches apart and the first configuration of stopping stations includes stopping stations having two roller nips, and the second configuration of stopping stations including stopping stations having three roller nips.

4. The buffer transport system of claim 1 wherein the sensors are optical sensors.

5. The buffer transport system of claim 1 wherein the motors driving the roller nips are servo motors.

6. The buffer transport system of claim 1 wherein the plurality of roller nips comprises twelve roller nips, wherein the first configuration of stopping stations comprises four stopping stations of three roller nips each, and wherein the second configuration of stopping stations comprises six stopping stations of two roller nips each.

* * * * *